US007276209B2

(12) United States Patent
Jossart

(10) Patent No.: US 7,276,209 B2
(45) Date of Patent: Oct. 2, 2007

(54) AIR-GAS MIXING SYSTEMS AND METHODS FOR ENDOTHERMIC GAS GENERATORS

(75) Inventor: Jason Jossart, Milwaukee, WI (US)

(73) Assignee: Atmosphere Engineering Co., LLC, Milwaukee, WI (US)

( * ) Notice: Subject to any disclaimer, the term of this patent is extended or adjusted under 35 U.S.C. 154(b) by 295 days.

(21) Appl. No.: 10/435,932

(22) Filed: May 12, 2003

(65) Prior Publication Data

US 2004/0228773 A1 Nov. 18, 2004

(51) Int. Cl.
*B32B 5/02* (2006.01)

(52) U.S. Cl. ..... 422/111; 422/112; 422/113; 148/208

(58) Field of Classification Search ..... 422/111, 422/112, 113; 48/196 R; 148/208
See application file for complete search history.

(56) References Cited

U.S. PATENT DOCUMENTS 4,869,730 A * 9/1989 Bhatnagar et al. ..... 48/113
5,074,533 A * 12/1991 Frantz ..... 268/254
5,364,476 A * 11/1994 Poor et al. ..... 148/27
5,554,230 A * 9/1996 Huber et al. ..... 148/208
5,828,582 A * 10/1998 Conklen et al. ..... 700/274
5,968,457 A * 10/1999 Van Den Sype et al. ... 422/177
6,051,078 A * 4/2000 Naito et al. ..... 148/215
6,106,636 A * 8/2000 Naito et al. ..... 148/215
2003/0131912 A1* 7/2003 Rancon et al. ..... 148/508

OTHER PUBLICATIONS

Waukee Engineering Co., Inc., How to Select and Install Flo-Meters for Gas Burner Systems, Milwaukee, Wisconsin. Date: Oct., 1997. p. 6, Fig. 6.
ASM Handbook, vol. 4 Heat Treating, Date: 1994. pp. 550-552, Fig. 7.
Berry, Theodore P., An Overview of Endothermic Generators, SSI Supersystems, Inc., Cincinnati, Ohio. Undated. pp. 1, 8, 9 and Figs. 1 and 2.
Waukee Engineering Company, Waukee Type "R" Mixor Bulletin, Milwaukee, Wisconsin. Date: 1957. p. 1.

* cited by examiner

*Primary Examiner*—N. Bhat
(74) *Attorney, Agent, or Firm*—Jannson Shupe & Munger Ltd.

(57) ABSTRACT

Systems and methods create an air-gas mixture supply for an endothermic generator. The systems and methods convey a hydrocarbon gas under pressure through a valve, to thereby form an air-gas mixture supply for the endothermic generator. The systems and methods sense an actual air-gas ratio of the air-gas mixture supply. The systems and methods receive from an operator a set point air-gas ratio. The systems and methods compare the actual value to the set point value and generate a deviation. The systems and methods generating a control signal to operate the valve based upon the deviation, and, preferably, to minimize the deviation.

25 Claims, 10 Drawing Sheets

AIR-GAS MIXING SYSTEMS AND METHODS FOR ENDOTHERMIC GAS GENERATORS

FIELD OF THE INVENTION

This invention relates to the generation of endothermic gas atmospheres for use, e.g., in the heat treating of metal parts. In particular, the invention relates to accurate and consistent air-gas mixing systems and methods for endothermic gas generators.

BACKGROUND OF THE INVENTION

Endothermic gas is used, e.g., as a protective atmosphere for the heat treatment of various metals and is also used as a carrier gas for carburizing. Most commonly, endothermic gas is prepared in an endothermic gas generator by reacting hydrocarbon gas and air in a reaction retort containing a catalyst at elevated temperature.

The composition of the endothermic gas is determined, inter alia, by the ratio of input air to hydrocarbon gas supplied to the retorts. Automatic systems for controlling the composition of an endothermic gas product are known. For example, a known fixed air/gas ratio control system has been used to set the ratio of hydrocarbon gas to air. These systems typically use orifices to control the gas and air input lines. These systems also make use of manual or automatic flap or "butterfly" valves, called trim valves, to make minor adjustments to that ratio in an attempt to keep the product endothermic gas at the desired composition.

In these prior mixing systems, the amount of trim control available is defined by the physical characteristics of the trim valves. A trim valve presents a fixed maximum orifice size when fully opened. Air velocity flow through a given system can vary significantly depending upon the demand for the air-gas mixture by the endothermic gas generator. Due to their physical characteristics, a trim valve may provide desired sensitivity and trim control at high flow rates through the retorts, but not at lower flow rates. For example, when fully opened, a trim valve may accommodate a flow of 600 cubic feet per hour (cfh). As FIG. 9 shows, at a generator demand of 6000 cfh, this represents a desirable maximum sensitivity, or trim value, of 10% (600 cfh/6000 cfh). However, as FIG. 9 demonstrates, at a lesser generator demand of 3000 cfh, the same trim valve offers a less desirable sensitivity or trim value of 20% (600 cfh/3000 cfh). At a still lesser generator demand of 1000 cfh, the same trim valve offers a much less desirable sensitivity of 60% (600 cfh/1000 cfh). Thus, while conventional mixing technology using trim valves may provide the requisite sensitivity at high demand flow rates, they do not provide the same sensitivity desired at lower demand flow rates. Turndown of generator output is desired to eliminate producing excess endothermic gas. Excess endothermic gas is typically wasted, thus increasing the cost of production. With conventional mixing technology, the desired degree of sensitivity and trim control at low demand flow rates cannot be achieved without separate control loops entailing additional control valves and complex logic circuitry.

SUMMARY OF THE INVENTION

The invention provides systems and methods for supplying an air-gas mixture to an endothermic generator in a desired ratio, with a high degree of desired sensitivity and trim control regardless of overall flow rate demand of the generator.

One aspect of the invention provides systems and methods that create an air-gas mixture supply for an endothermic generator. The systems and methods convey a hydrocarbon gas under pressure through a valve, to thereby form the air-gas mixture supply for the endothermic generator. The systems and methods sense an actual air-gas ratio of the air-gas mixture supply. The systems and methods receive from an operator a set point air-gas ratio. The systems and methods compare the actual value to the set point value and generate a deviation. The systems and methods generate a control signal to operate the valve based upon the deviation. Preferably, the systems and methods seek to minimize the deviation, so that the actual value is the set point value.

In one embodiment, the valve is a gas injection valve. The gas injection features of the invention make possible incremental changes in the air-gas ratio that can be precisely and instantaneously regulated. Furthermore, due to the controlled, precise manner in which gas can be injected, the gas injection features of the invention make possible a consistently small, desired sensitivity or trim value over the entire anticipated flow demand range of the generator (see FIG. 10). This results in a substantial improvement in performance, compared to conventional mixing with trim valves (as a comparison of FIGS. 9 and 10 show).

DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

Figure 1:
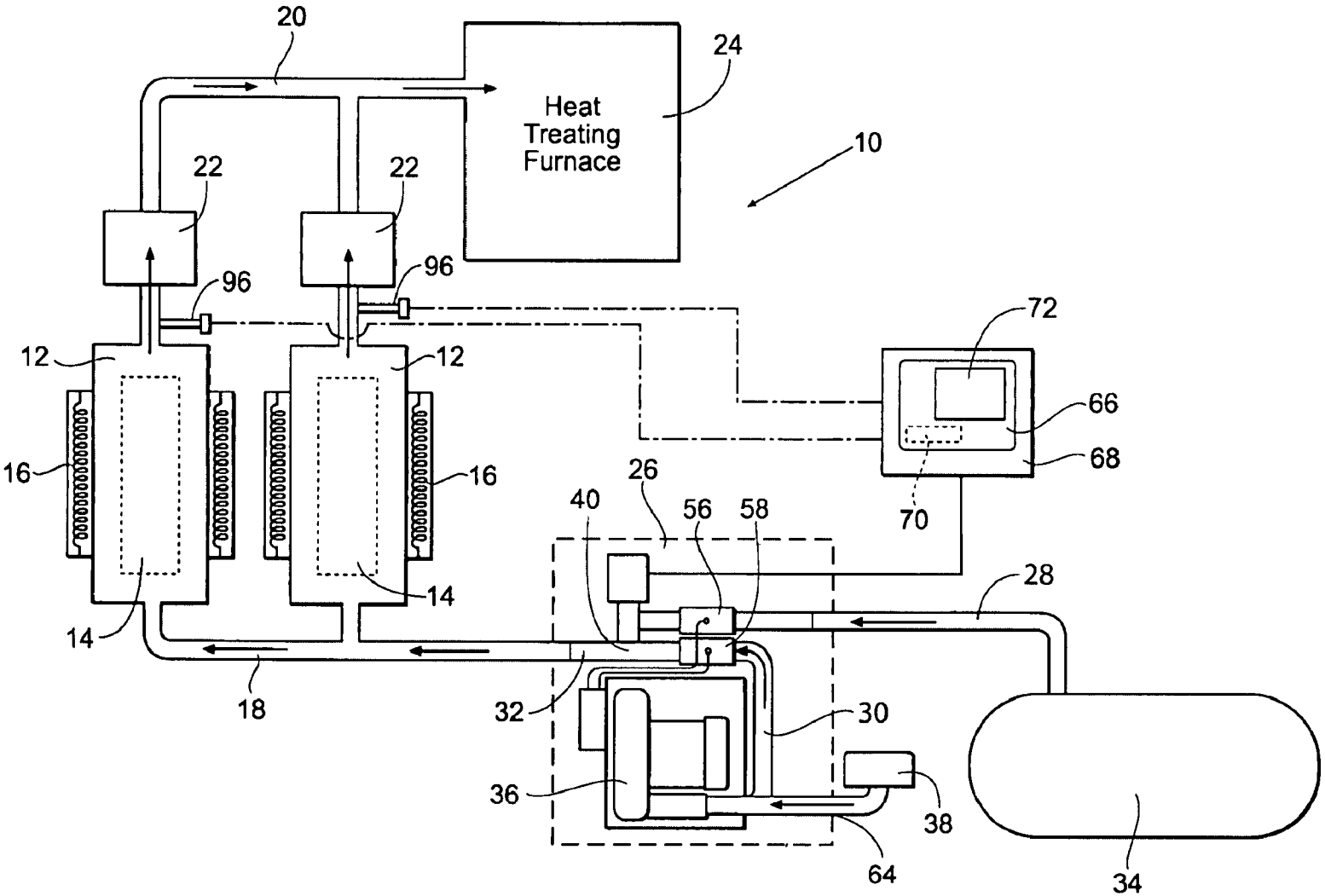
FIG. 1 is a schematic view of a system for generating an endothermic gas atmosphere for heat treating purposes.

FIG. 1 shows a system 10 for generating an endothermic gas atmosphere. The system 10 includes one or more gas retorts 12. Each retort 12 includes a catalyst bed 14, which typically comprises nickel impregnated upon an aluminum oxide or insulated firebrick clumps. Heaters 16 establish a desired temperature condition for the catalyst bed, typically about 1800° to 2200° F.

A supply line 18 conveys a mixture of air and hydrocarbon gas (e.g., natural gas) into each retort 12. The heated catalyst 14 promotes the cracking of chemical bonds in the air-gas mixture to produce an endothermic gas. An outlet line 20 conveys the endothermic gas from the retorts 12 through heat exchangers 22, which cool the endothermic gas. The retorts and associated components thus described are generically called "endothermic generators."

The cooled endothermic gas is conveyed to a destination, which typically is a heat treating furnace 24. The endothermic gas provides a protective atmosphere for the metal parts undergoing heat treatment in the furnace 24.

The desired composition of endothermic gases for a given heat treatment application is prescribed, e.g., by the American Society of Metals. For example, the prescribed composition for a Class 300 endothermic gas is 40% nitrogen, 40% hydrogen, and 20% carbon monoxide.

The composition of the endothermic gas is determined, inter alia, by the ratio of input air to hydrocarbon gas supplied to the retorts 12. For this reason, the system 10 includes a mixing assembly 26 communicating with the supply line 18. The function of the mixing assembly 26 is to provide an accurately controlled mixture of air and hydrocarbon gas to the retorts 12, which leads to the generation of an endothermic gas product having a desired composition. The composition of the endothermic gas is also called its "richness." The higher the ratio of hydrocarbon gas to air is, the "richer" is the generated endothermic gas. As before stated, it is desirable to produce an endothermic gas with a selected, consistent richness.

Figure 2A:
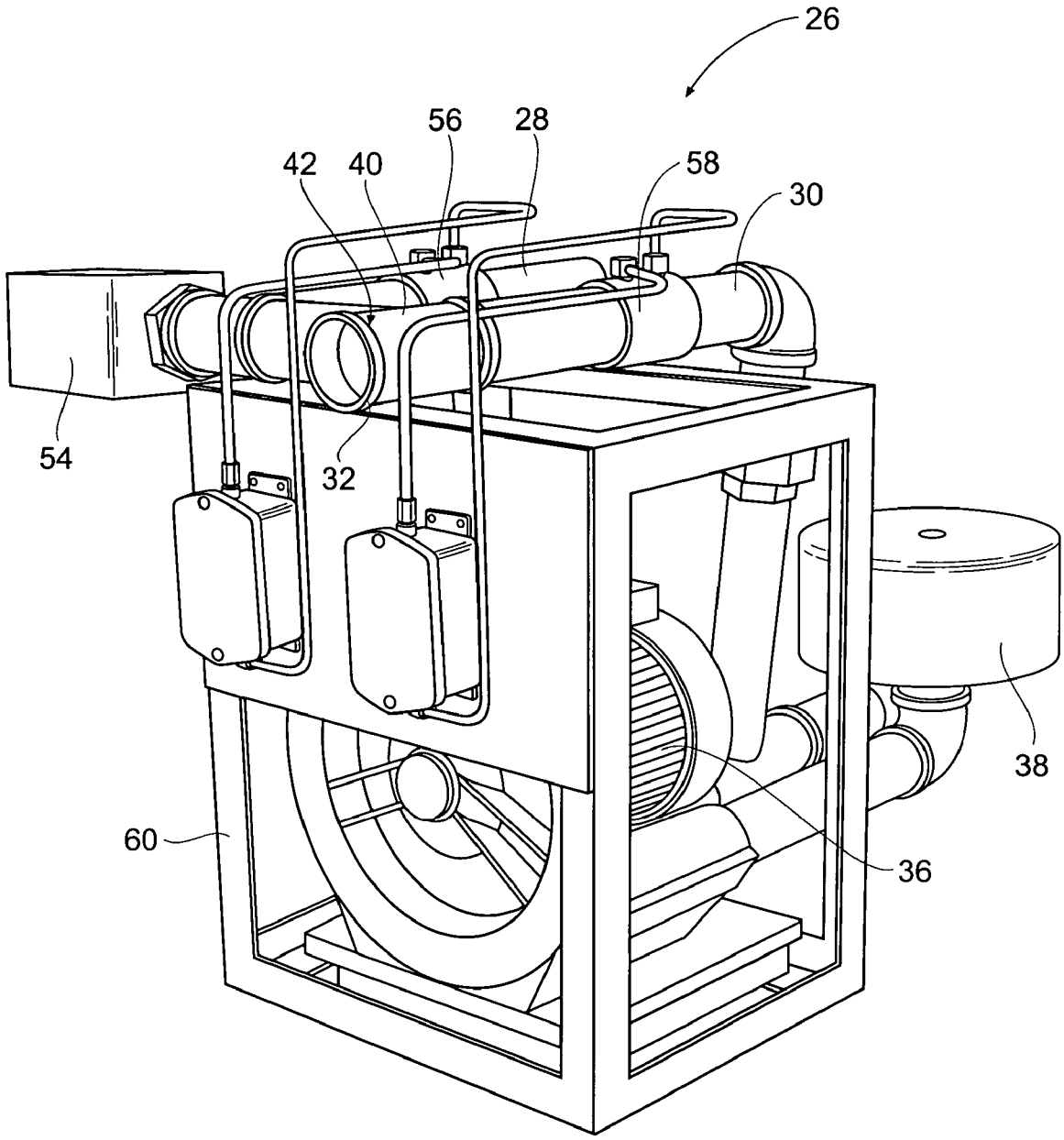
FIG. 2A is a perspective front view of an air-gas mixing assembly that the system in FIG. 1 incorporates.
Figure 2B:
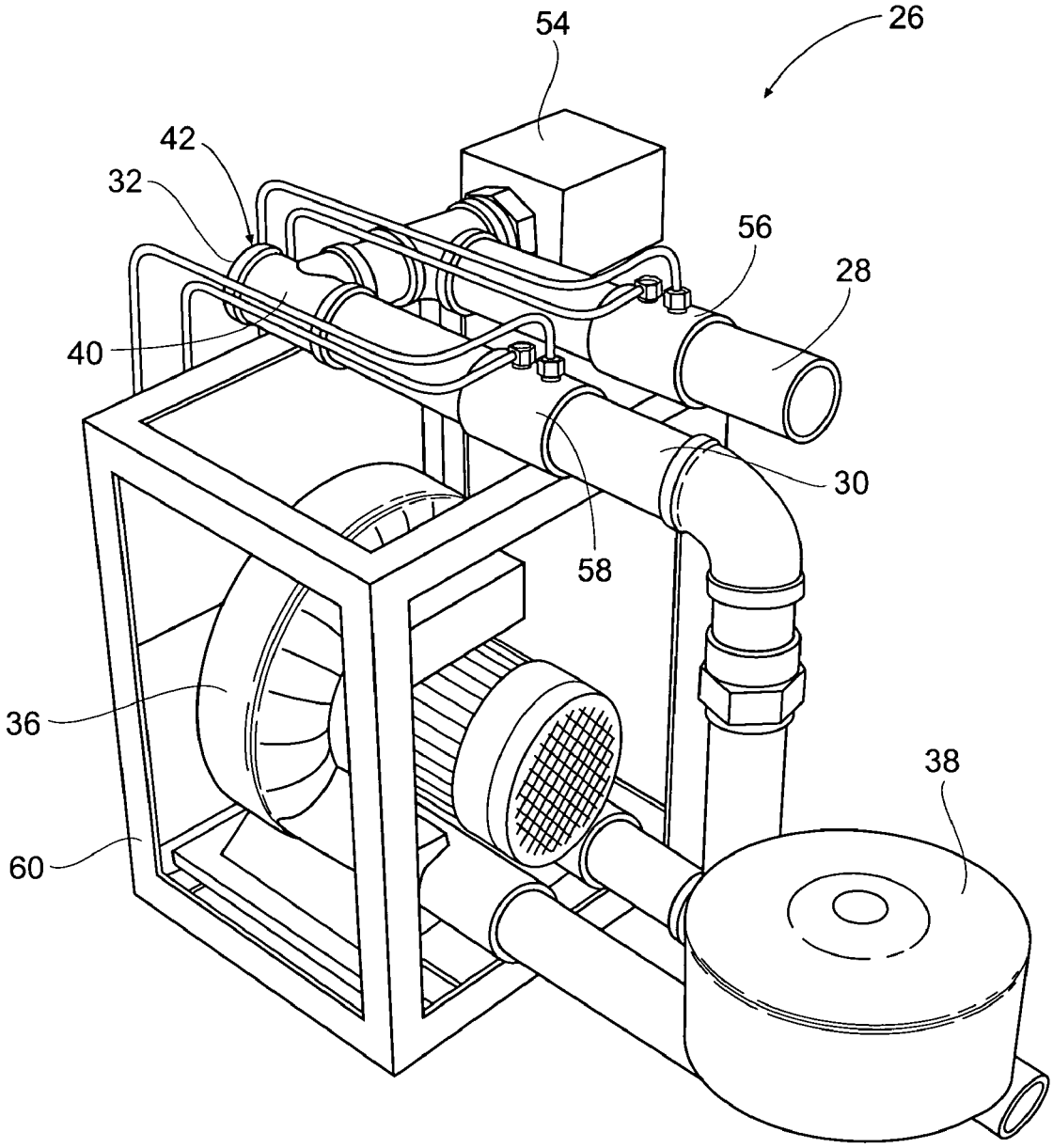
FIG. 2B is a perspective back view of an air-gas mixing assembly that the system in FIG. 1 incorporates.

As also shown in FIGS. 2A and 2B, the mixing assembly 26 includes a gas inlet line 28, and air inlet line 30, and mixed air-gas outlet line 32. The gas inlet line 28 is adapted to be coupled with a source 34 of a hydrocarbon gas (shown in FIG. 1), which supplies gas at a selected fixed pressure (e.g., 2 to 5 psig). The air inlet line 30 includes an air blower 36, which supplies ambient air, also at a set, fixed pressure. The air blower 36 preferably includes an inlet filter 38. The air blower 36 is desirably a regenerative air blower (220/440 VAC 3 Phase). A relief valve (not shown), with outlet pressure control, is desirably provided for the air inlet line 30 downstream of the blower 36.

The gas inlet line 28 and the air inlet line 30 intersect at an air-gas junction 40 (best shown in FIG. 2B). The air-gas junction 40 leads to the mixed air-gas outlet line 32. The mixed air-gas outlet line 32 is adapted to be coupled to the supply line 18 (as FIG. 1 shows), which leads to the retorts 12.

The gas inlet line 28 includes an internal injection valve assembly 42 (see FIG. 3) located immediately upstream of the air-gas junction 40. The injection valve assembly 42 includes a throat 44 having an inlet orifice 46 communicating with the gas inlet line 28 and an outlet orifice 48 communicating with the air-gas junction 40. The source 34 of pressure regulated hydrocarbon gas is coupled to the gas inlet line 28 (as FIG. 1 shows). Desirably, the gas supply is pressure regulated to at least 1 psig greater than the desired gas output pressure at the air-gas junction 40. Desirably, the gas is supplied at a pressure of 3 to 5 pounds per square inch gravity (psig).

The injection valve assembly 42 includes a valve rod 50 or needle with a tapered head 52. The valve rod 50 is aligned with the inlet orifice 46 of the throat 44. The tapered head 52 is sized to move within the inlet orifice 46. An injection passage 170 is defined between the exterior of the tapered head 52 and the interior of the inlet orifice 46. The dimensions of the injection passage 170 regulate the volume of pressurized gas that is directly injected through the outlet orifice 48 into the air-gas junction 40.

The injection valve assembly 42 further includes an actuator 54 coupled to the valve rod 50. In the illustrated embodiment, the actuator 54 comprises a stepper motor.

Figure 3:
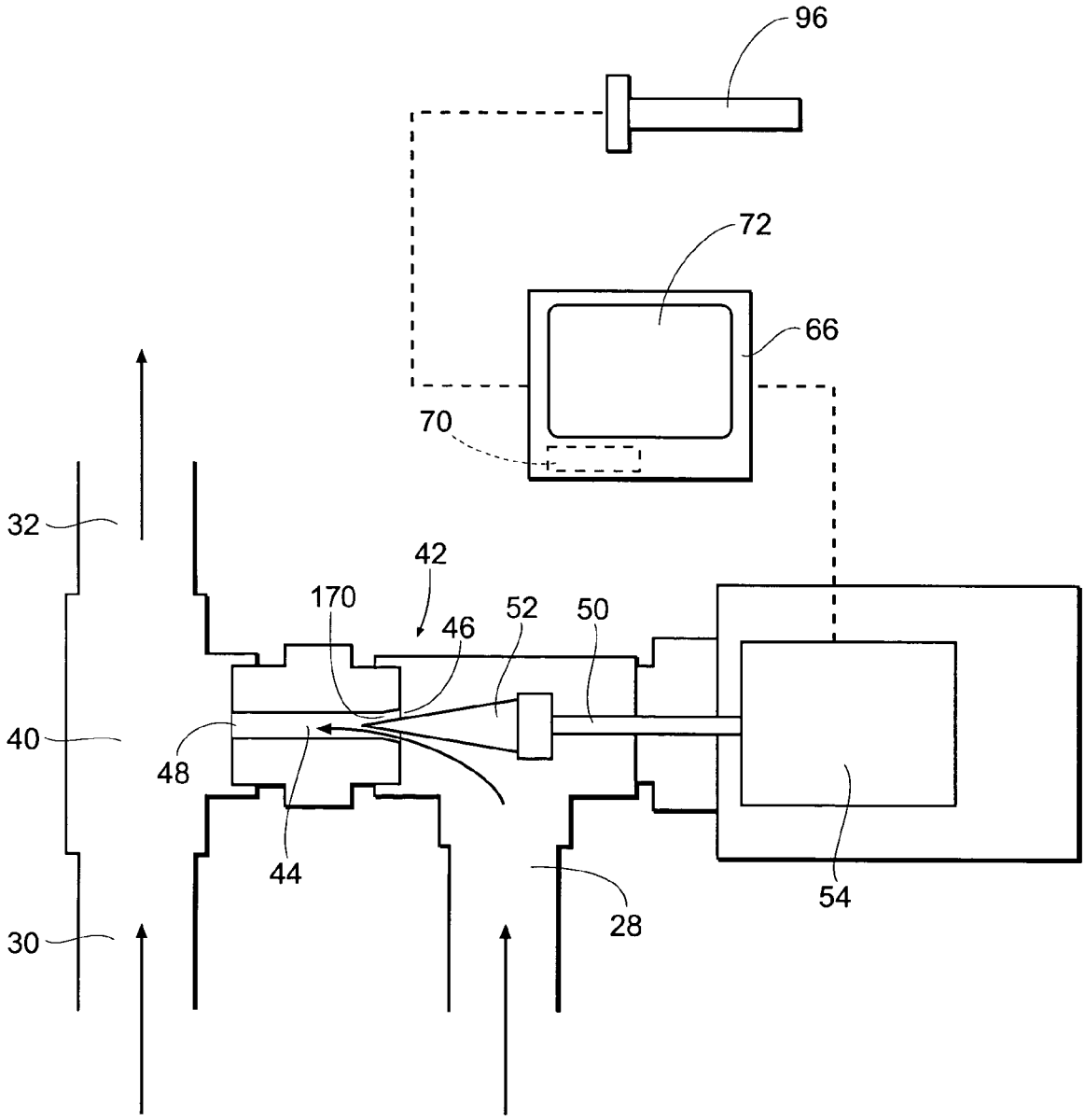
FIG. 3 is a schematic view of an injection valve assembly that the air-gas mixing assembly shown in FIGS. 2A and 2B incorporates, showing the valve member in a position between a fully closed and a fully opened condition.
Figure 4A:
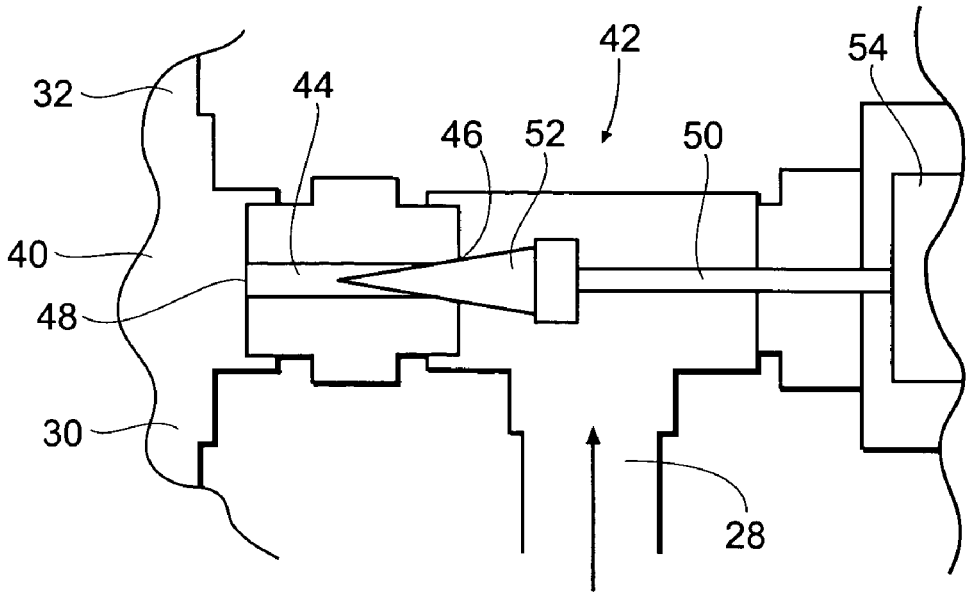
FIG. 4A is a schematic view of an injection valve assembly shown in FIG. 3, showing the valve member in a fully closed position.
Figure 4B:
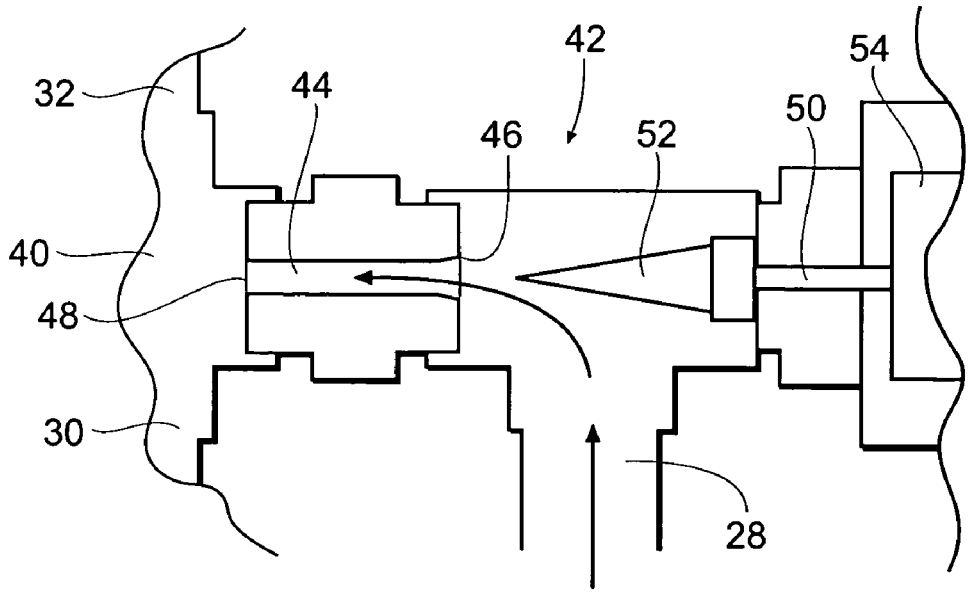
FIG. 4B is a schematic view of an injection valve assembly shown in FIG. 3, showing the valve member in a fully opened position.

The actuator 54 incrementally moves of the tapered head 52 of the valve rod 50 within the inlet orifice 46 between a fully seated position (see FIG. 4A), in which the tapered head 52 fully closes the inlet orifice 46 to the flow of gas, and a fully unseated position (see FIG. 4B), in which the tapered head 52 is free of the inlet orifice 46 and fully opens the inlet orifice 46 to the flow of gas. Incremental intermediate positions of the tapered head 52 within the inlet orifice 46 between the fully seated position and the fully unseated position (as FIG. 3 shows), incrementally regulate the dimensions of the injection passage 170 and thus incrementally regulate the volume of gas that is directly injected into the air-gas junction 40. By doing so, the flow rate of gas supplied subject to a fixed pressure in the gas inlet line 28 is also incrementally regulated.

Due to the geometric relationship between the tapered valve head 52 and the inlet orifice 46, incremental changes in injected gas volume through the injection passage 170 can be precisely and instantaneously regulated. As will be described in greater detail later, the controlled, precise injection of gas leads to the controlled, precise control of the air-gas ratio of the air-gas mixture in the air-gas junction 40 at any given point in time.

Figure 9:
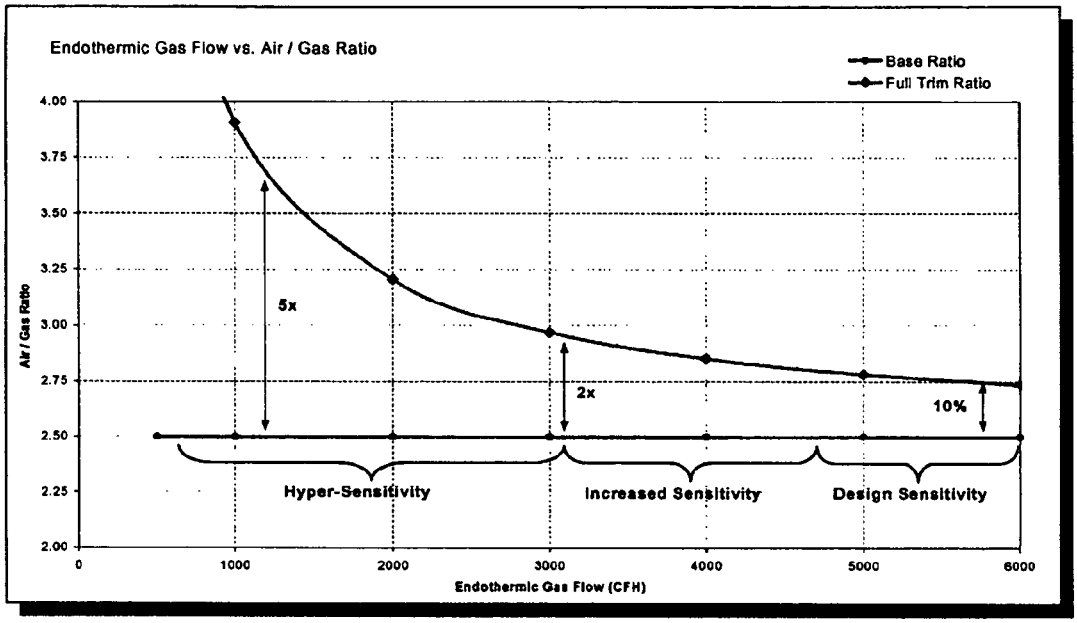
Fig. 9 (PRIOR ART)
FIG. 9 is a graph demonstrating the inability of prior art air-gas mixing systems employing mechanical or automatic flap trim valves maintain a desired degree of sensitivity and trim control consistently throughout the range of demand flow rates of the endothermic generator.
Figure 10:
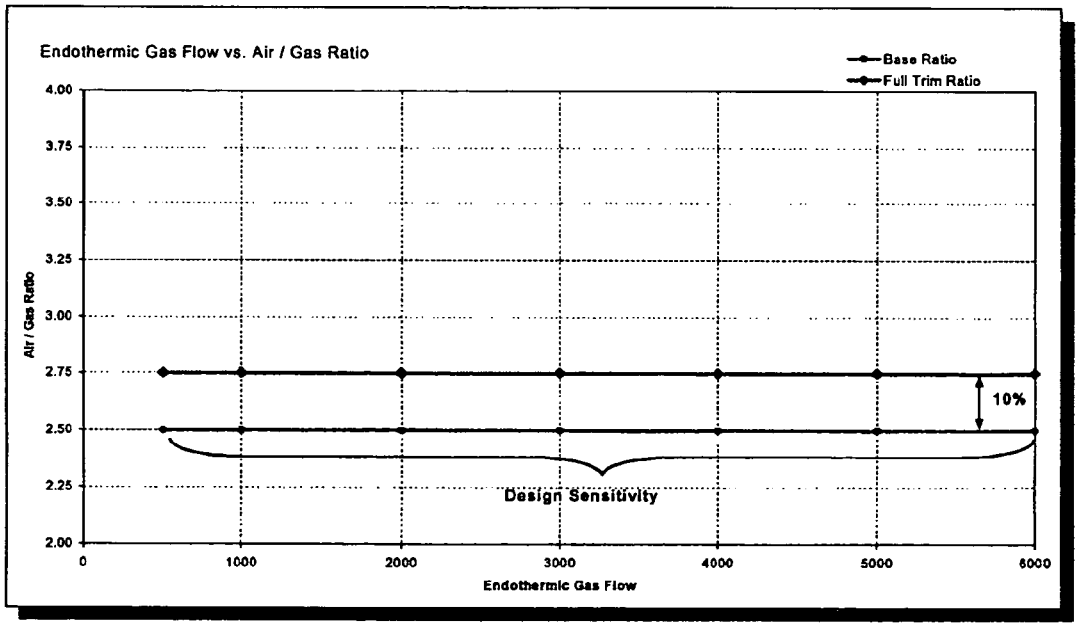
FIG. 10 is a graph demonstrating the ability of the system shown in FIG. 1, which employs a gas injection valve, to maintain a desired degree of sensitivity and trim control consistently throughout the range of demand flow rates of the endothermic generator.

Furthermore, due to the controlled, precise manner in which gas can be injected, the injection valve assembly 42 can provide a consistently small, desired sensitivity or trim value over the entire anticipated flow demand range of the generator (see FIG. 10). This results in a substantial improvement in performance, compared to convention mixing with trim flap valves (as a comparison of FIGS. 9 and 10 show).

The dimensions of the injection valve assembly 42 are selected to accommodate the anticipated range of endothermic gas demands of the system 10. For example, in a representative arrangement where a maximum flow rate of 1200 cfh at 2 psig is anticipated, the inlet orifice 46 can be sized with a diameter of about ⅞-inch. A minimum diameter for the tapered valve head 52 of about ¼-inch (fully opened) can be selected, and a maximum diameter being about ⅞-inch (fully closed) can be selected. The axial travel distance of the tapered head 52 from fully opened position to the fully closed position determines the taper of the head 52. The system provides an outlet pressure of 1 to 4 psig, with a turndown of 5:1 or greater. The system leads to the performance characteristics shown in FIG. 10.

The mixing assembly 26 desirably includes a gas flow sensing unit 56, which senses the rate of gas flow in the gas inlet line 28 upstream of the injection valve assembly 42. The gas flow rate will vary according to the regulation performed by the injection valve assembly 42.

The mixing assembly 26 also desirably includes an air flow sensing unit 58, which senses the rate of air flow in the air inlet line 30 upstream of the air-gas junction 40. The air flow rate will vary according to the endothermic gas demands imposed upon the generator. These demands will vary according to the demands of the heat treating furnace 24 or furnaces receiving the endothermic gas from the retorts 12.

The gas flow and air flow sensing units 56, 58 desirably comprise conventional electronic gas flow/air flow meters.

In the illustrated embodiment (see FIGS. 2A and 2B), the components of the mixing assembly 26 as described are mounted as an entire unit on a frame 60. The frame-mounted assembly 26 has an ambient air inlet 64 and is located away from radiant heat sources.

On site (as FIG. 1 also shows), the source 34 of pressure regulated hydrocarbon gas is coupled to the gas inlet line 28. As before stated, the gas supply is desirably pressure regulated to at least 1 psig greater than the desired gas output pressure at the air-gas junction 40. On site, the mixed air-gas outlet line 32 is coupled to the supply line 18 for the retorts 12, desirably through an appropriate fire check valve (not shown).

The system 10 also desirably includes a control module 66 for the mixing assembly 26. The control module 66 can comprise a main processing unit (MPU) that takes the form of a process controller located within a suitable cooled controls enclosure 68 (see FIG. 1) separate from unitary assembly 26 where the gas mixing assembly 26 itself is located.

The MPU can comprise one or more conventional microprocessors that support the preprogrammed process software, as described in greater detail later. The MPU desirably includes conventional RAM and a conventional nonvolatile memory device. The MPU includes an input device to upload programs into the memory device, e.g., a communications port. In the illustrated embodiment, a ratio control manager function 70 resides as process software in the memory device of the MPU.

The control module 66 can take the form of, e.g., an ENDOTHERM™ Controller (Model 2704) (itols™ programming software), or a HONEYWELL™ PLC, or a Microsoft® Windows® operating environment.

In the illustrated embodiment (see FIG. 1), the control module 66 includes a display device 72 for presenting system status and condition information to the operator. Desirably, the display device 72 also includes a data entry device using, e.g., a manual keypad on a navigation panel 76, or conventional touch screen methodologies implemented by the ratio control manager function 70 using a Windows®-based operating platform, or other suitable input interface platform (see FIGS. 5A, 5B, 7A, and 7B). In this arrangement, the combined data display and data entry capabilities that the ratio control manager function 70 executes, provide an interactive user interface on the display device 72. Under preprogrammed rules resident in the ratio control manager function 70, the user interface conveniently accepts data entry and displays in real time for the operator information relating to operational status and conditions of the system 10, with particular attention to the control of the composition of the endothermic gas product.

Preprogrammed rules resident in the ratio control manager function 70 affect control of the endothermic gas composition by creating and maintaining a desired air-to-gas ratio value in the air-gas mixture entering the retorts 12. The user interface allows the operator to view system operation and control from this perspective, by generation of a Ratio Control Screen 74 (see FIG. 5A). Desirably, the user interface can also allow the operator to select to view system operation from a different perspective of the dew point of the endothermic gas product itself, by generation a Dew Point Control Screen 78 (see FIG. 7A). Still, regardless of the format of the user interface on the display screen 72, the ratio control manager function 70 affects control of the endothermic gas composition by air-to-gas ratio control at the inlet end of the retorts 12.

A navigation panel 76 on the user interface is common to both the Ratio Control Screen 74 and the Dew Point Control Screen 78. The navigation panel 76 allows the operator to select the different user interfaces (i.e., Ratio Control Screen 74 or Dew Point Control Screen 78), e.g., by selection of a LOOP touch button 80. A MENU touch button 82 in the navigation panel 76, when selected, allows the operator to select various Set Up Screens 84 and 86 (see FIGS. 5B and 7B) associated with the Ratio Control Screen 74 and Dew Point Control Screen 78, as will be described in greater detail later. Access to the Set Up Screens 84 and 86 can be password protected, if desired. Other touch buttons 88 on the navigation panel 76 allow the operator to select menu options, enter settings, and otherwise navigate the user interface.

The control module 66 desirably includes sensed data inputs, through which the ratio control manager function 70 receives selected operational status data from external sensors. In one arrangement, the control module 66 can receive periodic input (e.g., once per second) from the air flow sensing unit 58 and the gas flow sensing unit 56 of the mixing assembly 26. Based upon these inputs, the ratio control manager function 70 can derive the actual instantaneous air flow (e.g., in standard cubic feet per hour, or scfh) and the actual instantaneous gas flow (e.g., also in scfh). The ratio control manager function 70 can also divide the actual sensed air flow by the actual sensed gas flow to derive the actual instantaneous air to gas ratio (which can be expressed as a dimensionless quantity). When the user interface reflects the ratio control perspective (see FIG. 5A), the ratio control manager function 70 desirably displays these periodically-derived quantities to the operator in alpha-numeric or graphical data fields 90, 92, and 94 on the Ratio Control Screen 74 of the user interface.

The control module 66 can also receive periodic input (e.g., once per second) based upon conditions sensed by sensors located in the endothermic gas output lines 20 of the retorts. In one arrangement, these sensors can comprise in-situ oxygen sensors and temperature sensors, which can take the form of combined oxygen/temperature sensing probes 96 (see FIG. 1). For example, the probes 96 can be of the type shown in U.S. Pat. No. 4,101,404. Commercial oxygen sensors can be used, e.g., the CARBONSEER™ or ULTRA PROBE™ sensors sold by Marathon Monitors, Inc., or ACCUCARB® sensors sold by Furnace Control Corporation. The probes 96 sense temperature and residual oxygen in the endothermic gas exiting the retorts 12, before the gas product is cooled.

Based upon well-known thermodynamic relationships, the sensed residual oxygen and the sensed temperature correlate to a quantity known as the dew point value (expressed in ° F.). Generally speaking, for endothermic gas produced from air and natural gas, a desired dew point value is about 35° F. A dew point value below about 20° F. is indicative of an undesired endothermic gas composition caused by the presence of too much hydrocarbon gas relative to air, which can lead to the deposit of carbon on the steel part exposed to the endothermic gas during heat treatment, a condition called sooting. A dew point value above about 70° F. is indicative of an undesired endothermic gas composition caused by the presence of too much air relative to gas, which can lead to the presence of water vapor and oxidation of the steel part exposed to the endothermic gas during heat treatment.

The ratio control manager function 70 receives as input a trim control signal based upon the input of the in-situ probes 96. The trim control signal is a function, typically based upon conventional proportional-integral-derivation (PID) methodologies, of the instantaneous difference between the sensed dew point value and a desired dew point value, as well as how quickly this difference is changing over time. The ratio control manager function 70 can itself include preprogrammed rules that derive the trim control signal based directly upon the electrical outputs of the probes 96. Alternatively, the ratio control manager function 70 can be conditioned to receive an analog trim control signal generated by a conventional external dew point controller coupled to the probes 96.

Figure 5A:
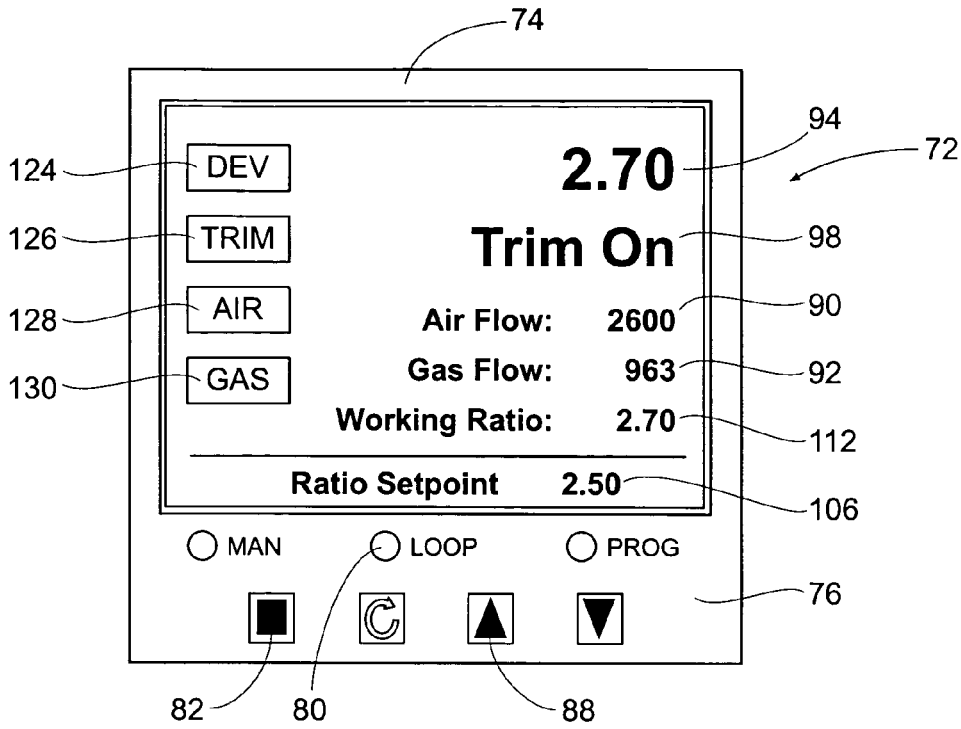
FIG. 5A is a view of the user interface of the control module that the system shown in FIG. 1 incorporates, showing the Ratio Control Screen.

The enablement of ratio control is indicated by Trim On field 98 in the trim status panel on the Ratio Control Screen 74 (see FIG. 5A). The trim status panel will indicate Trim Off in this field 98, if the automatic ratio control is not enabled. Furthermore, the Set Up Screen 84 associated with the Ratio Control Screen 74 (see FIG. 5B) desirably includes a trim control selection menu field 100, which allows the operator to define the origin of the trim control signal. For example, the selection of the term "External" in this menu field 100 conditions the ratio control manager function 70 to receive the trim control signal from an external dew point controller. The selection of the term "Internal" in this menu field 100 conditions the ratio control manager function 70 to derive the trim control signal from the probes 96 using its own preprogrammed rules, as will be described in greater detail later. The selection of the term "Off" in this field 100 conditions the ratio control manager function 70 to control using only a specified air-gas ratio set point, without reliance upon a trim control signal. The Set Up Screen 84 (see FIG. 5B) includes a read only field 102, which displays the current trim control signal (expressed as a percentage).

Figure 5B:
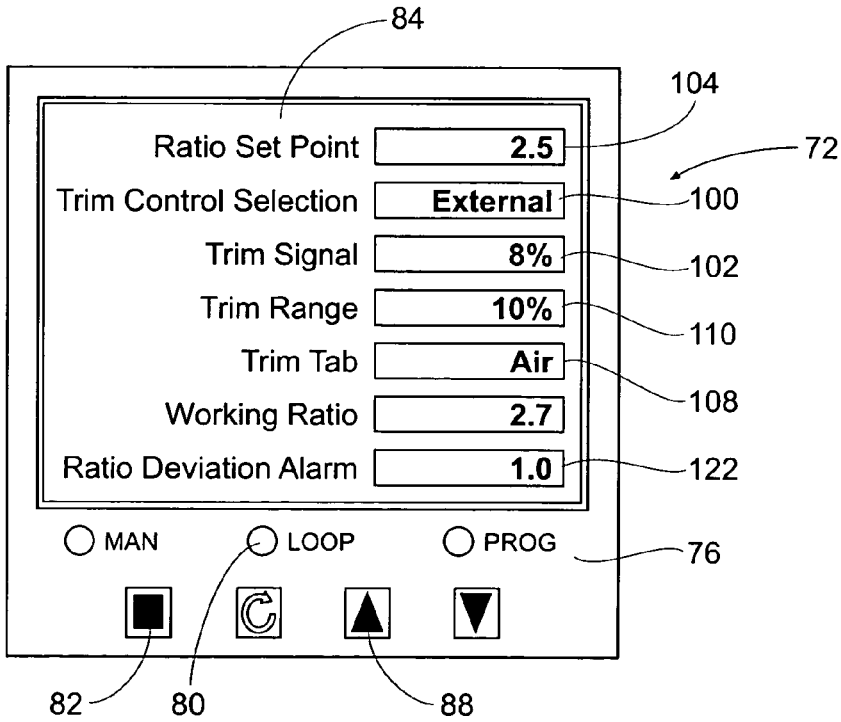
FIG. 5B is a view of the user interface of the control module that the system shown in FIG. 1 incorporates, showing the Set Up Screen for the Ratio Control Screen.

When the user interface comprises the Ratio Control Screen 74, the ratio control manager function 70 desirably permits the operator to specify an air-gas ratio set point using a data field 104 on the Set Up Screen 84 (see FIG. 5B). The particular air-gas ratio set point selected by the operator on the Set Up Screen 84 is also displayed in a corresponding field 106 on the Ratio Control Screen 74 (see FIG. 5A). The specified set point is the base air-gas ratio, which the trim control signal will either increase or decrease, provided either the External or Internal modes of operation are specified.

Generally speaking, endothermic gas produced from air and natural gas requires an air/gas ratio of between 2.0 and 3.0. The air-gas ratio set point is generally set to a value close to the ratio required to produce a pre-selected, desired dew point value. This value is based upon the retort characteristics and the manner in which the trim control signal generated for use by the ratio control manager function 70 is intended to affect the gas ratio. If the trim control signal is intended to increase the air-gas ratio (so-called "air trim"), the ratio set point for natural gas and air is about 2.5. If the trim control signal is intended to decrease the air-gas ratio (so-called "gas trim"), the ratio set point for natural gas and air is about 2.9. These set points may differ slightly due to the retort characteristics. The operator can specify Air Trim or Gas Trim mode in a menu field 108 on the Set Up Screen 84 (see FIG. 5B).

The ratio control manager function 70 also permits the operator to specify a trim range in a menu field 110 on the Set Up Screen 84 (see FIG. 5B). The trim range is expressed as a percentage between 0 and 100. The trim range defines the maximum extent to which the trim signal can modify the ratio set point (the value of the set point assumes a zero percent trim range). Typically, the default value is 10%, which provides for ratio control within a realistically sensitive control band, to thereby mitigate against large changes in the endothermic gas composition over time. Specifying greater percentage values for the trim range will allow larger ratio changes, which lead to greater possible deviation of the endothermic gas composition over time.

The ratio control manager function 70 desirably displays a working ratio in a field 112 on the Ratio Control Screen 74 (see FIG. 5A). The working ratio is the specified air-gas ratio set point, after taking into account the trim signal and trim range. If air trim is selected, the trim signal is added to the ratio set point based upon the specified trim range. If gas trim is selected, the trim signal is subtracted from the ratio set point based upon the specified trim range.

On the Ratio Control Screen 74 (shown in FIG. 5A), the working ratio will change based upon the trim signal, i.e., based upon sensed oxygen and temperature conditions (i.e., dew point) of the endothermic gas product. On the Ratio Control Screen 74, the working ratio is the actual ratio the ratio control manager function 70 will seek to maintain, as will be described in greater detail later.

The ratio control manager function 70 periodically senses the instantaneous air flow rate and an instantaneous gas flow rate. These flow rates are displayed in fields 90 and 92 on the Ratio Control Screen 74. From these instantaneous flow rates, the ratio control manager function 70 derives an actual instantaneous air-gas ratio. This air-gas ratio is also displayed in a field 94 on the Ratio Control Screen 74.

Figure 6:
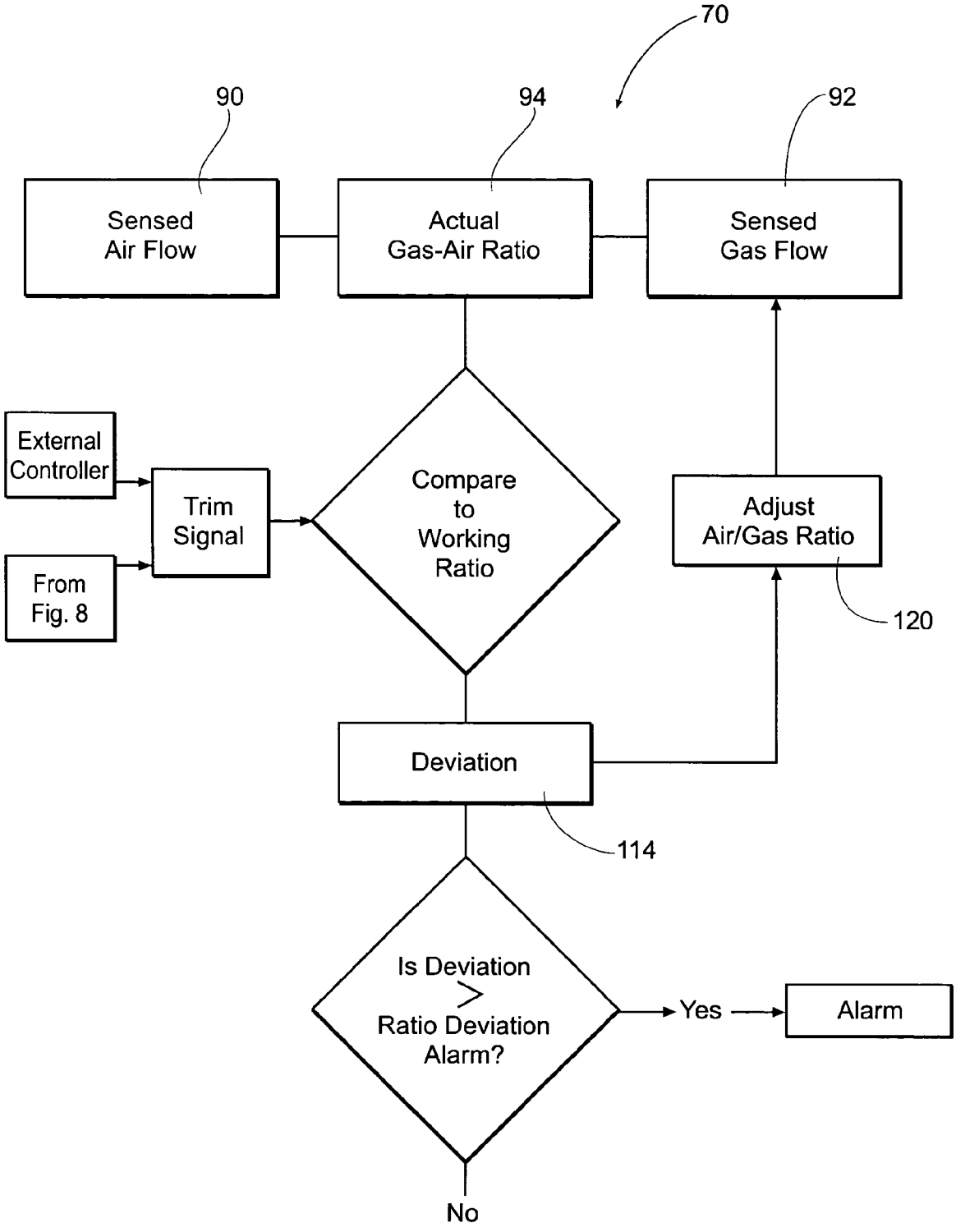
FIG. 6 is a flow chart of the ratio control manager function that the control module of the system shown in FIG. 1 incorporates, showing the execution of an air-gas ratio control method supported by the Ratio Control Screen.

As shown in FIG. 6, in use, the ratio control manager function 70 compares the instantaneous air-gas ratio derived from real time sensing to the working ratio created based upon the specified set point ratio, the trim signal and the specified trim range. The ratio control manager function 70 generates a deviation 114 based upon the difference between the actual and working ratios. Based upon the magnitude of the deviation 114—and preferably also taking to account how the deviation is changing over time (e.g., using conventional PID methodologies)—the ratio control manager function 70 derives a ratio adjustment signal 120. This signal 120 commands the actuator 54 (see FIG. 3) to move the valve rod 50 (the head 52 of which meters the flow of gas through the inlet orifice 46 and into the air-gas junction 40) in a direction that will minimize the deviation, i.e., by allowing more gas or less gas to enter the air-gas junction 40. Instantaneous movement of the valve rod 50 leads to instantaneous changes in the air-gas ratio of the mixture in the air-gas junction 40, which is then conveyed to the retorts 12. The ratio control manager function 70 performs successive loops of sensing actual conditions, calculating an actual ratio based upon sensed actual conditions, comparing the actual ratio to the working ratio, generating a ratio adjustment signal, and commanding valve rod movement based upon the ratio adjustment signal. The result is precise control of the air to gas ratio of the mixture entering the retorts 12, to thereby obtain an endothermic gas product having a prescribed, consistent composition.

Desirably (see FIG. 5B), if the Ratio Control Screen 74 is selected as the user interface, the ratio control manager function 70 permits the operator to specify in a field 122 on the Set Up Screen 84 a ratio deviation alarm value. The ratio control manager function 70 compares the ratio deviation with the deviation alarm value. If the ratio deviation exceeds the alarm value, the ratio control manager function 70 generates a signal that illuminates the Deviation Alarm LED 124 on the Ratio Control Screen 74 (see FIG. 5A).

Other LED's can be provided on the Ratio Control Screen 74 to provide status information to the operator. For example, a Trim Alarm LED 126 can be illuminated when the trim control signal is not within anticipated limits, indicating faulty wiring or a loss of integrity of the trim control signal. When the Trim Alarm LED 126 is illuminated, the ratio control manager function 70 does not take the trim control signal into account. As another example, Air and Gas LED's 128 and 130 can be illuminated when the respective flow signal is not within anticipated limits, indicating faulty wiring or a loss of integrity of the flow sensors.

The user interface created by the Ratio Control Screen 74 (shown in FIG. 5A) allows the operator to view system operation from a "quantity control" perspective. The composition and consistency of the endothermic gas product is characterized on the Ratio Control Screen 74 with respect to the input side of the generator, by specifying an air-gas ratio entering the retorts 12.

Figure 7A:
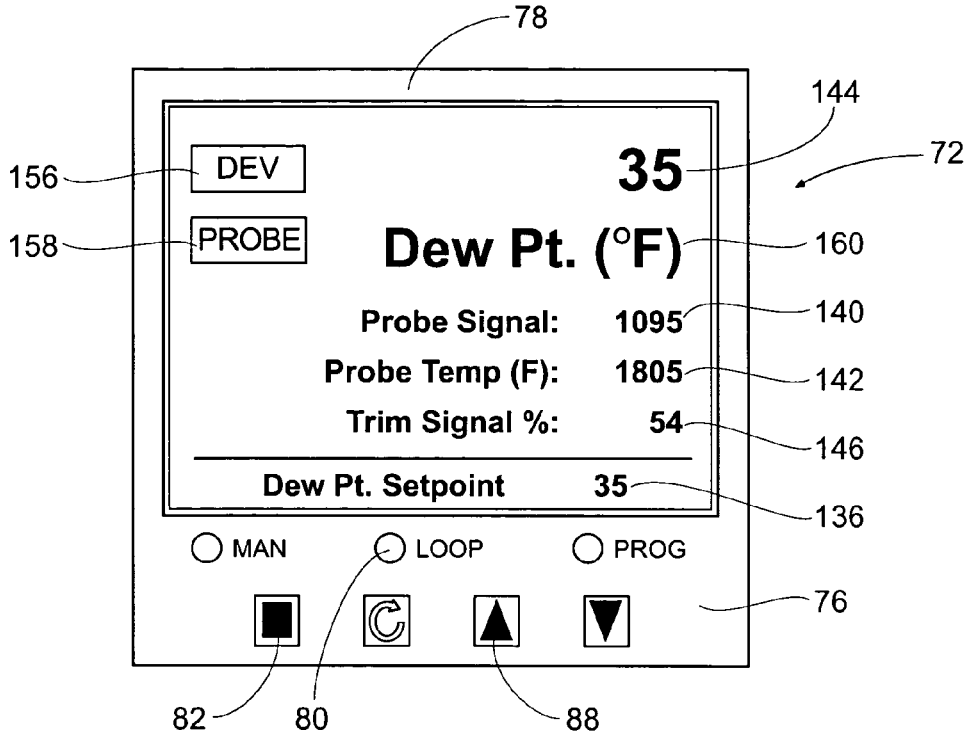
FIG. 7A is a view of the user interface of the control module that the system shown in FIG. 1 incorporates, showing the Dew Point Control Screen.

When the operator selects the Dew Point Control Screen 78 as the user interface (as shown in FIG. 7A), the operator views system operation from a "quality control" perspective. In this modality, the composition and consistency of the endothermic gas product is characterized by the Dew Point Control Screen 78 with respect to the output side of the generator, by specifying a dew point value for the endothermic gas exiting the retorts 12.

Regardless of the informational perspective of the user interface, the underlying ratio control manager function 70 serves to control the composition and consistency of the endothermic gas product the same way, by active control of the air-gas ratio at the input side of the generator.

To enable use of the Dew Point Control Screen 78 (see FIG. 7A) as the user interface, the ratio control manager function 70 must itself include preprogrammed rules that derive a dew point value as well as the trim control signal based directly upon the electrical outputs of the probes 96 (an external dew point controller will provide the trim control signal, but will not output a probe reading, a temperature reading, or a dew point value for display by the Dew Point Control Screen 78). The trim control section field 102 in the Set Up Screen 84 for the Ratio Control Screen 74 (see FIG. 5B) must also be set to Internal. Once enabled, the ratio control manager expresses operating conditions for the system on the Dew Point Control Screen 78 in the context of dew point units (in ° F.), as the data field 160 on the Dew Point Control Screen 78 indicates. Still, the underlying control rationale of the ratio control manager function 70 in terms of its generation of a ratio adjustment signal 120 and adjustment of the air-gas ratio by operation of the injection valve assembly 42 are not altered by selection of the Dew Point Control Screen 78.

Figure 7B:
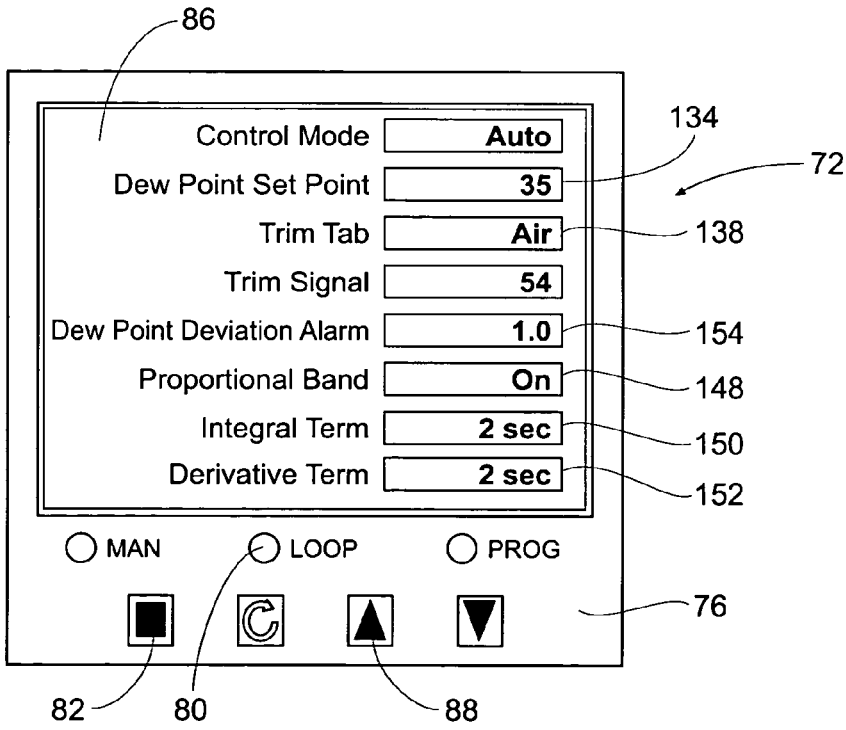
FIG. 7B is a view of the user interface of the control module that the system shown in FIG. 1 incorporates, showing the Set Up Screen for the Dew Point Control Screen.

When the user interface comprises the Dew Point Control Screen 78, the ratio control manager function 70 desirably permits the operator to specify a dew point set point using a data field 134 on the associated Set Up Screen 86 (see FIG. 7B). The particular dew point set point selected by the operator on the Set Up Screen 86 is also displayed in a field 136 on the Dew Point Control Screen 78. The specified set point is the dew point that the ratio control manager function 70 will maintain. The operator must specify Air Trim in a menu field 138 on the Set Up Screen 86 (see FIG. 7B) when using the internal dew point control features of the ratio control manager.

When the user interface comprises the Dew Point Control Screen 78, the ratio control manager function 70 periodically (e.g., once every second) receives the residual oxygen content signal (in millivolts) and the temperature signal (converted to ° F.) from the probes 96 sampling the endothermic gas product. The Dew Point Control Screen 78 displays these sensed values in data fields 140 and 142. Based upon the sensed input, the ratio control manager function 70 computes an actual instantaneous dew point value, which is displayed in a data field 144 in the Dew Point Control Screen 78.

Figure 8:
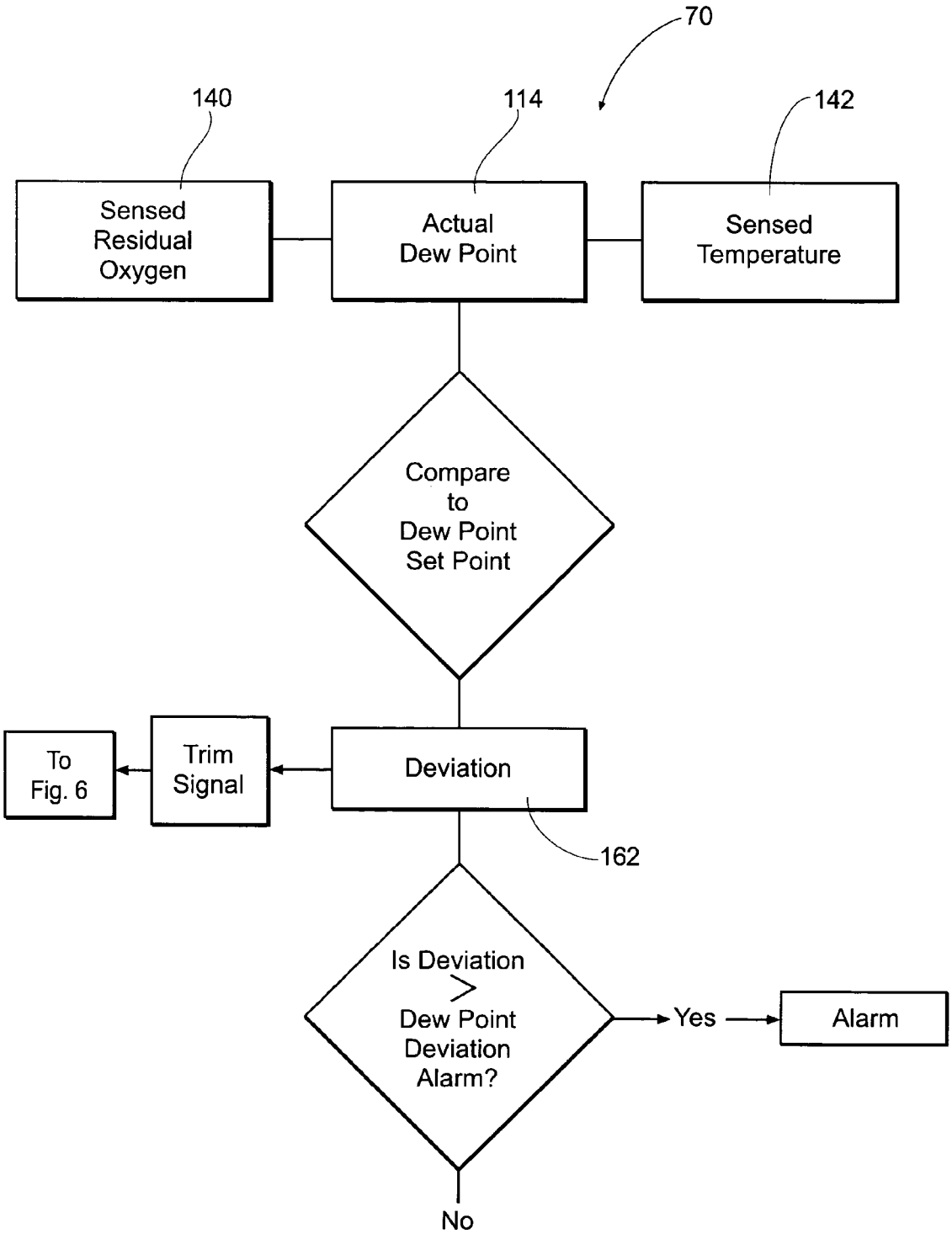
FIG. 8 is a flow chart of the ratio control manager function that the control module of the system shown in FIG. 1 incorporates, showing the execution of a air-gas ratio control method supported by the Dew Point Control Screen.

As FIG. 8 shows, the ratio control manager function 70 compares the instantaneous dew point value derived from real time sensing to the specified dew point set point. The ratio control manager function 70 generates a deviation 162 based upon the difference between the actual dew point value and desired dew point value. Based upon the deviation 162, the ratio control manager function 70 derives trim control signal, which is also displayed in a data field 146 on the Dew Point Control Screen 78. The internally generated trim control signal is used by the ratio control manager function 70 to calculate the working ratio, as previously described, in the same way that the ratio control manager 70 calculates the working ratio based upon an externally generated trim signal. As previously described (and as also shown in FIG. 5A), the working ratio is the actual ratio the ratio control manager function 70 will seek to maintain, by comparison of the working ratio to an actual instantaneous air-gas ratio (derived from real time sensing), and the generation of a deviation. Based upon the deviation (as already described), the ratio control manager function 70 derives the ratio adjustment signal 120.

The ratio control manager function 70 applies the ratio adjustment signal 120 to the actuator 54 of the valve rod 50 (see FIG. 3). By selecting the Proportional Band menu field 148 on the Set Up Screen 86 (see FIG. 7B), the ratio adjustment signal 120 applied is proportional to the size of the deviation. By selecting the Integral Term menu field 150 (in seconds) on the Set Up Screen 86, an integral term removes the steady state control offset by ramping the ratio adjustment signal 120 up or down in proportion to the amplitude and duration of the deviation. By selecting the Derivative Term menu field 152 (in seconds) on the Set Up Screen 86, a derivative term is included that is proportional to the rate of change of the dew point value over time. In this way, the ratio control manager function 70 incorporates conventional PID methodologies to the generation of the ratio adjustment signal 120.

As before described, the ratio adjustment signal 120 commands the actuator to move the valve rod 50 (the head 52 of which meters the flow of gas through the inlet orifice and into the air-gas junction 40) in a direction that will minimize the deviation between the actual dew point value and the dew point value set point, i.e., by allowing more gas or less gas to enter the air-gas junction 40. Instantaneous movement of the valve rod 50 leads to instantaneous changes the air-gas ratio of the mixture in the air-gas junction 40, which is then conveyed to the retorts 12. The ratio control manager function 70 performs successive loops of sensing actual residual oxygen and temperature conditions, calculating an actual dew point based upon sensed actual conditions, comparing the actual dew point to the dew point set point, generating a ratio adjustment signal, and commanding valve rod movement based upon the ratio adjustment signal. The result is precise control of the air to gas ratio of the mixture entering the retorts, to thereby obtain an endothermic gas product having a desired dew point.

Desirably, if the Dew Point Control Screen 78 is selected as the user interface, the ratio control manager function 70 permits the operator to specify in the field 154 on the Set Up Screen 86 a dew point deviation alarm value. The ratio control manager function 70 compares the dew point deviation with the deviation alarm value. If the dew point deviation exceeds the alarm value, the ratio control manager function 70 generates a signal that illuminates the Deviation Alarm LED 156 on the Dew Point Control Screen 78.

Other LED's can be provided on the Dew Point Control Screen 78 to provide status information to the operator. For example, a Probe LED 158 can be illuminated when a probe signal is not within anticipated limits, indicating faulty wiring or a loss of integrity of the probes 96.

If desired, the control module 66 can also incorporate other control manager functions, e.g., for temperature control for the retorts 12. These additional control manager functions can be enabled by selecting the appropriate function Control Screen using the LOOP touch button 80 on the navigation panel 76.

The mixing assembly 26 and associated control module 66 provide an accurate and maintenance-free gas mixing system for endothermic generators. The ratio control manager function 70 of the control module 66 makes possible electronic flow measurement and the use of a precise injection trim valve assembly to consistently provide exactly the desired air-gas mixture for high quality endothermic gas generation. The mixing assembly 26 and associated control module 66 deliver air-gas flow on demand throughout the working range of the endothermic generator, thereby substantially eliminating endothermic gas waste during production.

The ratio control manager function 70 of the control module 66 makes possible programmable trim band control, with a ratio deviation alarm to ensure the production of high quality endothermic gas, which can protect the catalyst of the generator from premature sooting due to probe/sensor degeneration. The unitary frame mounting of the mixing assembly 26 facilitates the easy replacement of existing manual carburetor/pump-based systems with an efficient gas injection system, making possible significant reduction in endothermic gas production costs.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. An air-gas mixing assembly adapted to be coupled to an endothermic generator comprising:

a gas inlet line constructed and arranged for coupling to a pressurized source of a hydrocarbon gas;

an air inlet line constructed and arranged for coupling to a pressurized source of air;

an air-gas junction communicating with the gas inlet line and the air inlet line and with the endothermic generator; and an injection valve assembly in the gas inlet line upstream of the air-gas junction, through which a volume of hydrocarbon gas is injected under pressure into the air-gas junction, the injection valve assembly including a controlled member that regulates the volume of the hydrocarbon gas injection in response to a control signal thereby providing a controlled mixture of air and hydrocarbon gas to the endothermic generator.

2. An air-gas mixing assembly adapted to be coupled to an endothermic generator comprising:

a gas inlet line constructed and arranged for coupling to a pressurized source of a hydrocarbon gas;

an air inlet line constructed and arranged for coupling to a pressurized source of air;

an air-gas junction communicating with the gas inlet line and the air inlet line and with the endothermic generator; and an injection valve assembly in the gas inlet line upstream of the air-gas junction through which a volume of hydrocarbon gas is injected under pressure upstream of the endothermic generator, the injection valve assembly including a controlled member that regulates the volume of the hydrocarbon gas injection in response to a control signal thereby providing a controlled mixture of air and hydrocarbon gas to the endothermic generator.

3. An air-gas mixing assembly according to claim 1 or 2 wherein the controlled member includes a valve throat having an inlet orifice communicating with the gas inlet line and an outlet orifice communicating with the air-gas junction, a valve member within the inlet orifice to define a gas flow passage having a dimension in the inlet orifice, the valve member being movable to adjust the dimension of the gas flow passage.

4. An air-gas mixing assembly according to claim 3 wherein the valve member includes a tapered head aligned with the inlet orifice.

5. An air-gas mixing assembly adapted to be coupled to an endothermic generator comprising:

a gas inlet line constructed and arranged for coupling to a pressurized source of a hydrocarbon gas;

an air inlet line constructed and arranged for coupling to a pressurized source of air;

an air-gas junction communicating with the gas inlet line and the air inlet line and with the endothermic generator; and a valve assembly in the gas inlet line upstream of the air-gas junction, through which a volume of hydrocarbon gas is conveyed under pressure into the air-gas junction, the valve assembly including a controlled member that regulates the volume of the hydrocarbon gas conveyance in response to a control signal thereby providing a controlled mixture of air and hydrocarbon gas to the endothermic generator.

6. An air-gas mixing assembly adapted to be coupled to an endothermic generator comprising:

a gas inlet line constructed and arranged for coupling to a pressurized source of a hydrocarbon gas;

an air inlet line constructed and arranged for coupling to a pressurized source of air;

an air-gas junction communicating with the gas inlet line and the air inlet line and with the endothermic generator; and an injection valve assembly in the gas inlet line upstream of the air-gas junction, through which a volume of hydrocarbon gas is injected under pressure into the air-gas junction, the injection valve assembly including a controlled member that regulates the volume of the hydrocarbon gas injection in response to a control signal thereby providing a controlled mixture of air and hydrocarbon gas to the endothermic generator.

7. An air-gas mixing assembly according to claim 1 or 2 or 5 or 6 wherein the air inlet line includes an air flow sensing unit.

8. An air-gas mixing assembly according to claim 1 or 2 or 5 or 6 wherein the gas inlet line includes a gas flow sensing unit.

9. An air-gas mixing assembly according to claim 1 or 2 or 5 or 6 wherein the air inlet line includes an air blower.

10. An air-gas mixing assembly according to claim 1 or 2 or 5 or 6 further including:

a frame; and wherein the air inlet line, the gas inlet line, air-gas junction, and the injection valve assembly are mounted on the frame and comprise a unitary frame assembly.

11. An air-gas mixing assembly according to claim 1 or 2 or 5 or 6 further including a control module adapted and arranged to be coupled to the controlled member, the control module including a control function manager for generating the control signal.

12. An air-gas mixing assembly according to claim 11 wherein the control function manager generates the control signal to maintain a desired air-gas ratio.

13. An air-gas mixing assembly according to claim 11 wherein the control function manager generates the control signal based upon sensing air flow in the air inlet line and gas flow in the gas flow line.

14. An air-gas mixing assembly according to claim 11 wherein the control function manager generates the control signal to maintain an air-gas ratio to maintain a desired dew point in an endothermic gas product of the endothermic generator.

15. An air-gas mixing assembly according to claim 14 wherein the control function manager generates the control signal based upon sensing a dew point of the endothermic gas product.

16. An air-gas mixing assembly according to claim 11 wherein the control module includes a display device, and wherein the control function manager generates a user interface on the display device.

17. An air-gas mixing assembly according to claim 16 wherein the user interface includes a field for displaying an air-gas ratio.

18. An air-gas mixing assembly according to claim 16 wherein the user interface includes a field for displaying a dew point of an endothermic gas product of the endothermic generator.

19. A control module for an air-gas mixing system coupled to an endothermic generator comprising:

a gas injection valve adapted and arranged to be coupled to the air-gas mixing system to inject gas under pressure into a flow of air, to thereby form an air-gas mixture supply for the endothermic generator;

a control input for sensing an actual air-gas ratio of the air-gas mixture supply;

a control input for receiving from an operator a set point air-gas ratio;

a control output coupled to the gas injection valve; and a ratio control function manager that compares the actual air-gas ratio to the set point air-gas ratio and generates a deviation, the ratio control function generating a control signal through the control output to operate the gas injection valve based upon the deviation.

20. A control module according to claim 19 wherein the control signal operates the gas injection valve to minimize the deviation.

21. A control module according to claim 19 further including a display device, and wherein the ratio control function manager generates a user interface on the display device.

22. A control module according to claim 21 wherein the user interface includes a field that displays at least one of the actual air-gas ratio and the set point air-gas ratio.

23. A control module for an air-gas mixing system coupled to an endothermic generator comprising:

a gas injection valve adapted and arranged to be coupled to the air-gas mixing system to inject gas under pressure into a flow of air, to thereby form an air-gas mixture supply for the endothermic generator;

a control input for sensing an actual dew point of an endothermic gas product of the endothermic generator;

a control input for receiving from an operator a set point dew point;

a control output coupled to the gas injection valve; and a ratio control function manager that compares the actual dew point to the set point dew point and generates a deviation, the ratio control function generating a control signal through the control output to operate the gas injection valve based upon the deviation.

24. A control module according to claim 23 wherein the control signal operates the gas injection valve to minimize the deviation.

25. A control module according to claim 23 further including a display device, and wherein the ratio control function manager generates a user interface on the display device.

* * * * *